US010525736B2

(12) United States Patent
Amari

(10) Patent No.: US 10,525,736 B2
(45) Date of Patent: Jan. 7, 2020

(54) RECORDING APPARATUS

(71) Applicant: MIMAKI ENGINEERING CO., LTD., Nagano (JP)

(72) Inventor: Tomonori Amari, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/726,386

(22) Filed: Oct. 6, 2017

(65) Prior Publication Data

US 2018/0099512 A1 Apr. 12, 2018

(30) Foreign Application Priority Data

Oct. 7, 2016 (JP) ..... 2016-199519

(51) Int. Cl.

| | |
|---|---|
| ***B41J 2/165*** | (2006.01) |
| ***B41J 11/00*** | (2006.01) |
| ***B41J 2/01*** | (2006.01) |
| ***B41J 13/02*** | (2006.01) |

(52) U.S. Cl.

CPC ..... *B41J 11/0015* (2013.01); *B41J 2/01* (2013.01); *B41J 11/007* (2013.01); *B41J 11/0085* (2013.01); *B41J 13/025* (2013.01)

(58) Field of Classification Search

USPC ..... 347/22, 23, 104

See application file for complete search history.

(56) References Cited

U.S. PATENT DOCUMENTS

| | | | | |
|---|---|---|---|---|
| 10,052,896 | B2 * | 8/2018 | Yamaguchi | B41J 29/17 |
| 2006/0238596 | A1 * | 10/2006 | Mitsuhashi | B41J 11/007 347/104 |

FOREIGN PATENT DOCUMENTS

| | | | |
|---|---|---|---|
| EP | 1560080 | | 8/2005 |
| JP | 2003205658 | | 7/2003 |
| JP | 2009078397 | A * | 4/2009 |
| JP | 4687328 | | 5/2011 |

OTHER PUBLICATIONS

"Search Report of European Counterpart Application," dated Feb. 13, 2018, p. 1-p. 9, in which the listed references were cited.

* cited by examiner

*Primary Examiner* — Lam S Nguyen
(74) *Attorney, Agent, or Firm* — JCIPRNET

(57) ABSTRACT

A smaller recording apparatus is provided, and includes a transport device that transports a print target medium using an endless transport belt placed around a plurality of rollers, an inkjet head that performs a recording on a medium on the endless transport belt, and a cleaning unit that cleans the endless transport belt. The cleaning unit includes a cleaner, making contact with the endless transport belt in a width direction thereof, so as to clean the endless transport belt with a cleaning liquid; a cleaning liquid tank, storing the cleaning liquid and includes at least a part of the cleaner; and a moving mechanism, supporting the cleaner and the cleaning liquid tank, and moving the cleaner in a horizontal direction between a contact position where the cleaner makes contact with the endless transport belt and a separated position where the cleaner is separated from the endless transport belt.

17 Claims, 7 Drawing Sheets

RECORDING APPARATUS

CROSS REFERENCE TO RELATED APPLICATIONS

This application claims the priority benefit of Japanese Patent Application No. 2016-199519, filed on Oct. 7, 2016. The entirety of the above-mentioned patent application is hereby incorporated by reference herein and made a part of this specification.

TECHNICAL FIELD

This disclosure relates to a recording apparatus.

DESCRIPTION OF THE BACKGROUND ART

A known art provides an inkjet recording apparatus equipped with a transport belt cleaning device including a belt cleaning roller. In the inkjet recording apparatus, a medium is transported by an endless transport belt placed around a plurality of rollers and cleaned by the belt cleaning roller (for example, Japanese Patent No. 4687328). The cleaning device is moved by a drive device, so as to have the belt cleaning roller contact and draw away from the transport belt in a direction orthogonal to the transport belt.

Patent Literature 1: Japanese Patent No. 4687328

SUMMARY

In the recording apparatus described in Japanese Patent No. 4687328, the belt cleaning roller is moved in a direction orthogonal to the transport belt. This apparatus, therefore, is required to control the vertical position of the belt cleaning roller. When a wider transport belt is used, for example, a belt cleaning roller should be correspondingly wider, and the cleaning device may be increased in weight. Then, a larger drive device may be necessary to move such a larger and heavier cleaning device.

To address the issues of the known art, this disclosure is directed to providing a recording apparatus reducible in size.

This disclosure provides a recording apparatus, including: a transport device, configured to transport a print target medium using an endless transport belt placed around a plurality of rollers; a recording device, configured to perform a recording on the print target medium on the endless transport belt; and a cleaning unit, configured to clean the endless transport belt. The cleaning unit includes: a cleaner, configured to make contact with the endless transport belt in a width direction of the endless transport belt, so as to clean the endless transport belt with a cleaning liquid; a cleaning liquid tank, configured to store the cleaning liquid, and at least a part of the cleaner is included in the cleaning liquid tank; and a moving mechanism, configured to support the cleaner and the cleaning liquid tank, and move the cleaner in a horizontal direction between a contact position at which the cleaner makes contact with the endless transport belt and a separated position at which the cleaner is separated from the endless transport belt.

In this recording apparatus, the cleaner and the cleaning liquid tank are moved in the horizontal direction by the moving mechanism. The recording apparatus thus structured to horizontally reciprocate the whole cleaning unit at once may be reducible in size.

The plurality of rollers include at least a first roller, a second roller, and a third roller. The print target medium is transported between the first and second rollers from the first roller toward the second roller. The third roller is disposed at a position below the first roller and the second roller. The cleaner is disposed at a position below the first roller and above the third roller.

By locating the cleaner below the first roller and above the third roller, efficient removal of the cleaning liquid from the transport belt may certainly be possible without having to upsize the cleaning unit.

The cleaner may contact the endless transport belt by pressing the endless transport belt against the third roller.

By pressing the transport belt against the third roller, the cleaner may avoid loss of contact with the transport belt without using any additional member. This may allow the cleaner to more reliably scrape off and remove any extraneous matter attached to the transport belt.

The cleaner may include: a cleaning roller, configured to rotate and clean the endless transport belt; and a suction roller, disposed downstream in a transport direction of the endless transport belt relative to the cleaning roller. The suction roller makes contact with the endless transport belt to suction the cleaning liquid from the endless transport belt. An outer periphery of the cleaning roller is partly immersed in the cleaning liquid stored in the cleaning liquid tank.

A better cleaning performance may be provided by constantly feeding the cleaning roller with the cleaning liquid during the cleaning of the transport belt. By having the downstream-side suction roller suction the cleaning liquid transferred from the cleaning roller to the transport belt, efficient removal of the cleaning liquid from the transport belt may certainly be possible. Thus, better cleaning by and thorough removal of the cleaning liquid may be both achieved.

The cleaning unit may further include: a squeezing roller, configured to make contact with the suction roller, so as to squeeze the cleaning liquid off the suction roller. An axis of a rotating shaft of the squeezing roller may be on a side opposite to the endless transport belt across a straight line passing through axes of rotating shafts of the cleaning roller and of the suction roller.

This may ensure that the cleaning liquid squeezed off the suction roller by the squeezing roller drops into the cleaning liquid tank.

The axis of the rotating shaft of the squeezing roller may be on a vertically lower side than the axis of the rotating shaft of the suction roller and is closer to the transport belt than the axis of the rotating shaft of the suction roller.

This may further ensure that the cleaning liquid squeezed off the suction roller by the squeezing roller drops into the cleaning liquid tank.

The cleaning roller may have a rotational speed changeable in response to an average transport speed of the endless transport belt.

This may avoid damage to the transport belt and resulting wear of the cleaning roller.

Thus, the recording apparatus disclosed herein may be reducible in size.

DETAILED DESCRIPTION OF EMBODIMENTS

An embodiment is hereinafter described in detail referring to the accompanying drawings. The embodiment is a non-limiting example of this disclosure. Structural and technical features described in the embodiment below may include such that are replaceable by those skilled in the art or substantially identical.

[Embodiment]

Figure 1:
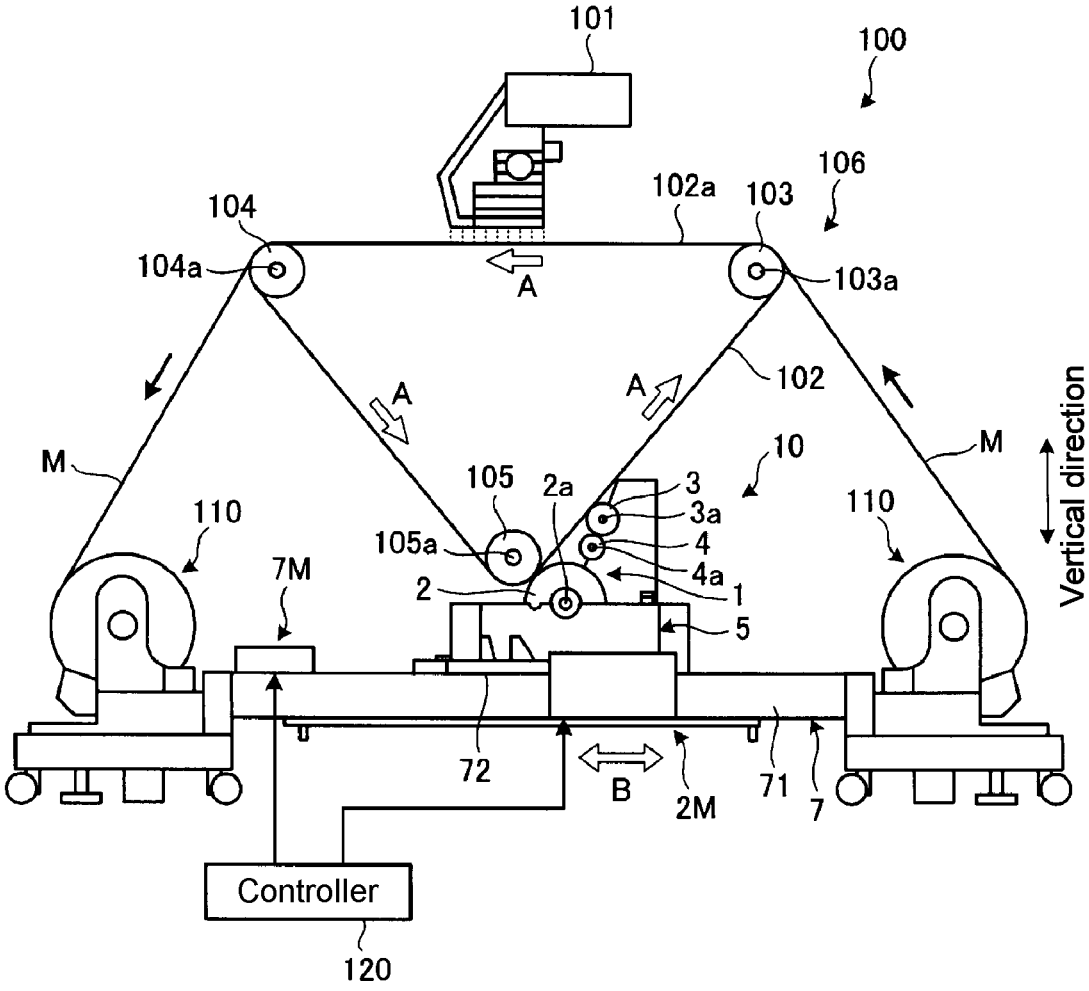
FIG. 1 is a schematic front view of an inkjet printer equipped with a cleaning unit according to an embodiment.
Figure 2:
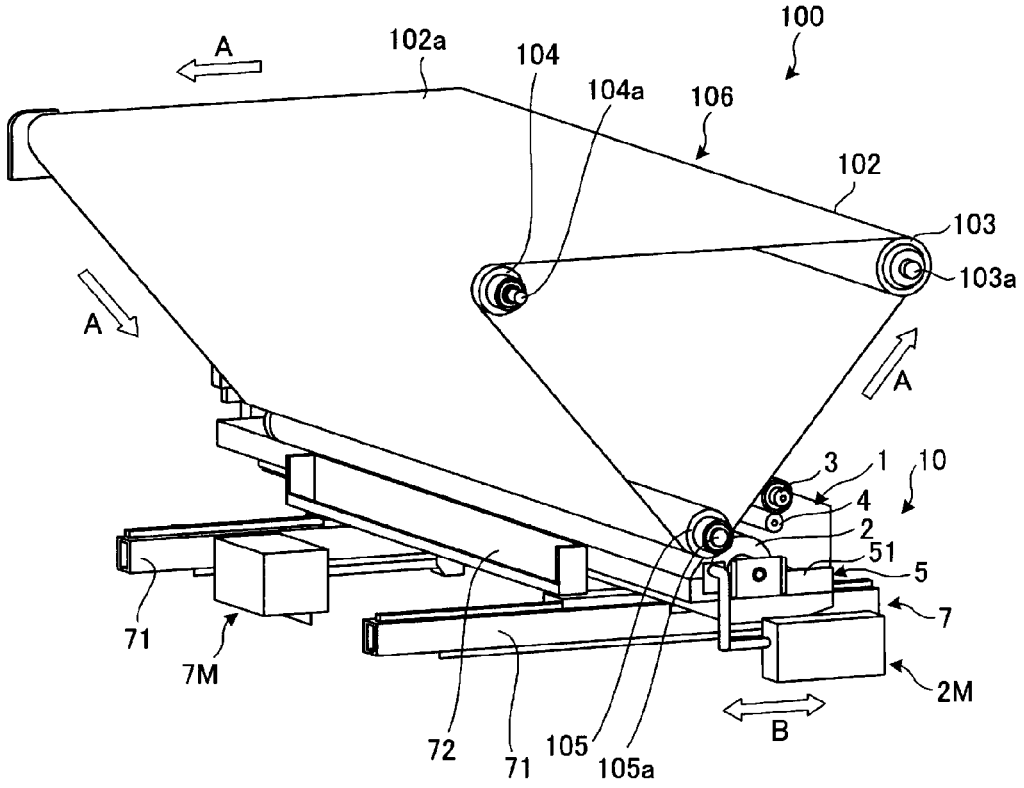
FIG. 2 is a schematic perspective view of the inkjet printer equipped with a cleaning unit according to the embodiment.
Figure 3:
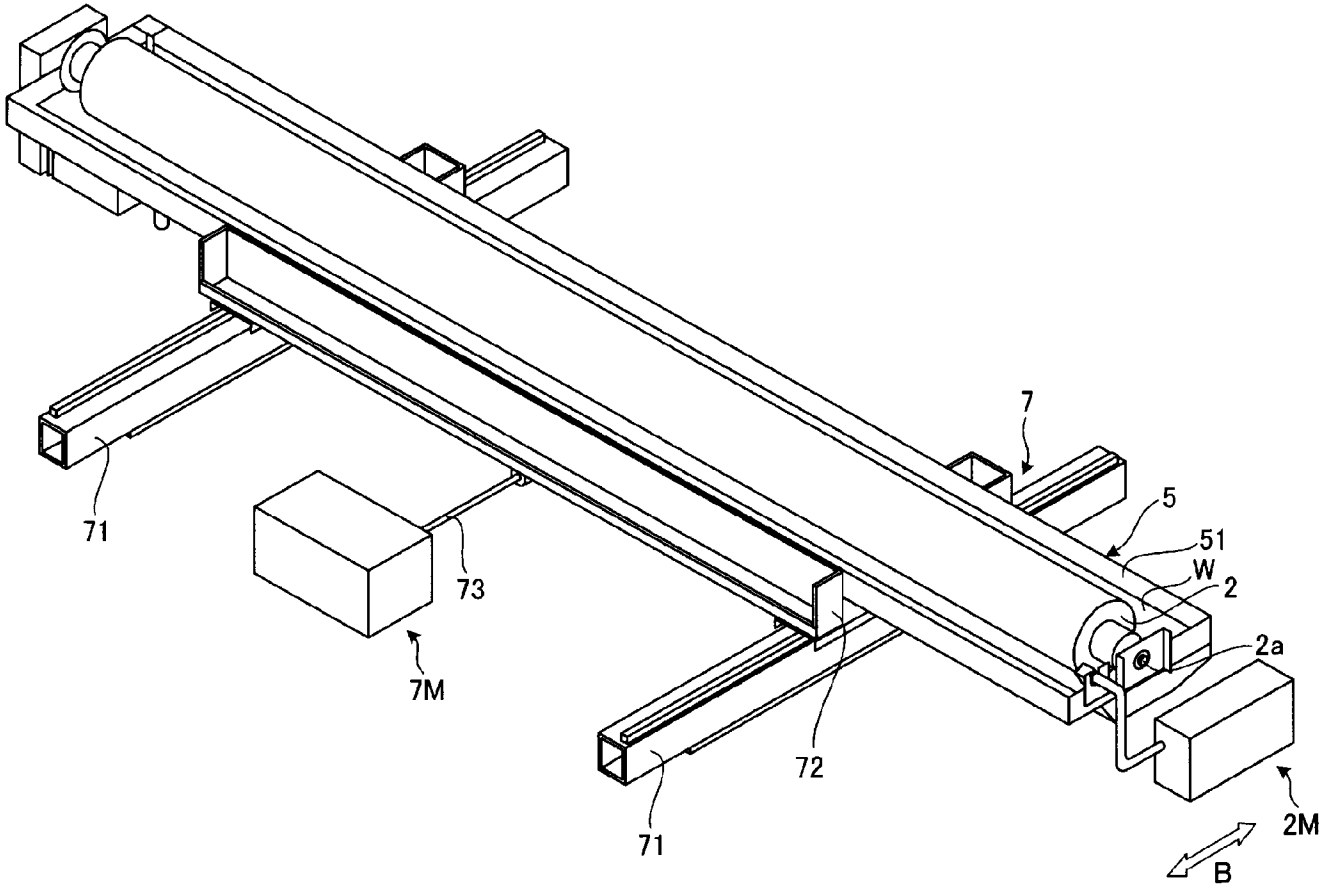
FIG. 3 is a schematic perspective view of a cleaning roller, a cleaning liquid tank, and a moving mechanism of the cleaning unit according to the embodiment.
Figure 4:
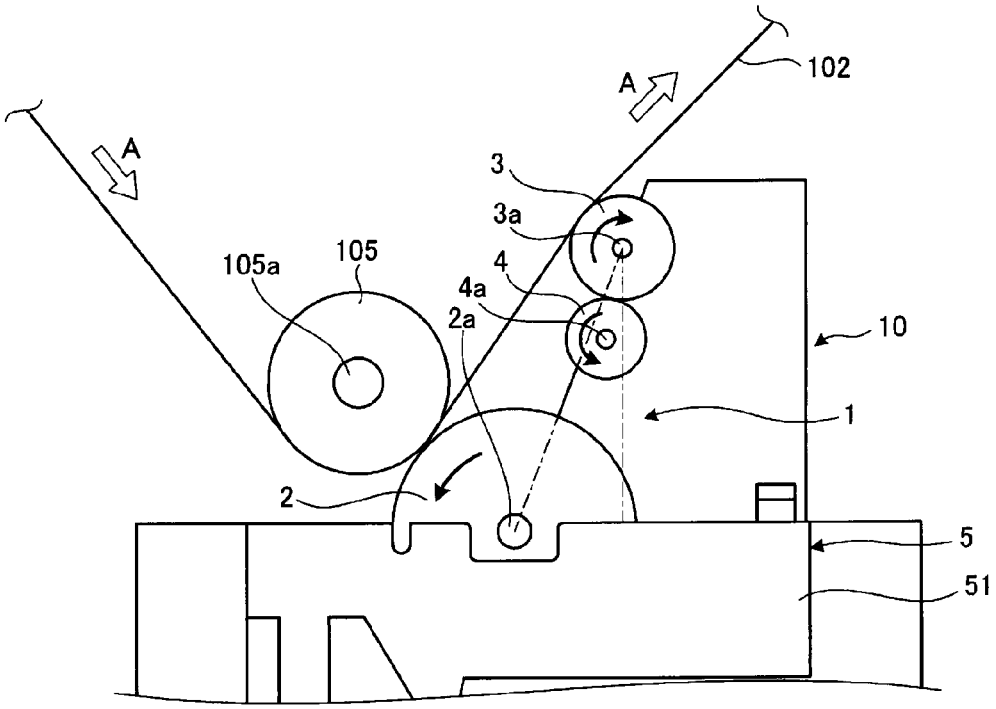
FIG. 4 is a partly enlarged view of the cleaning unit and a transport belt at a contact position according to the embodiment.
Figure 5:
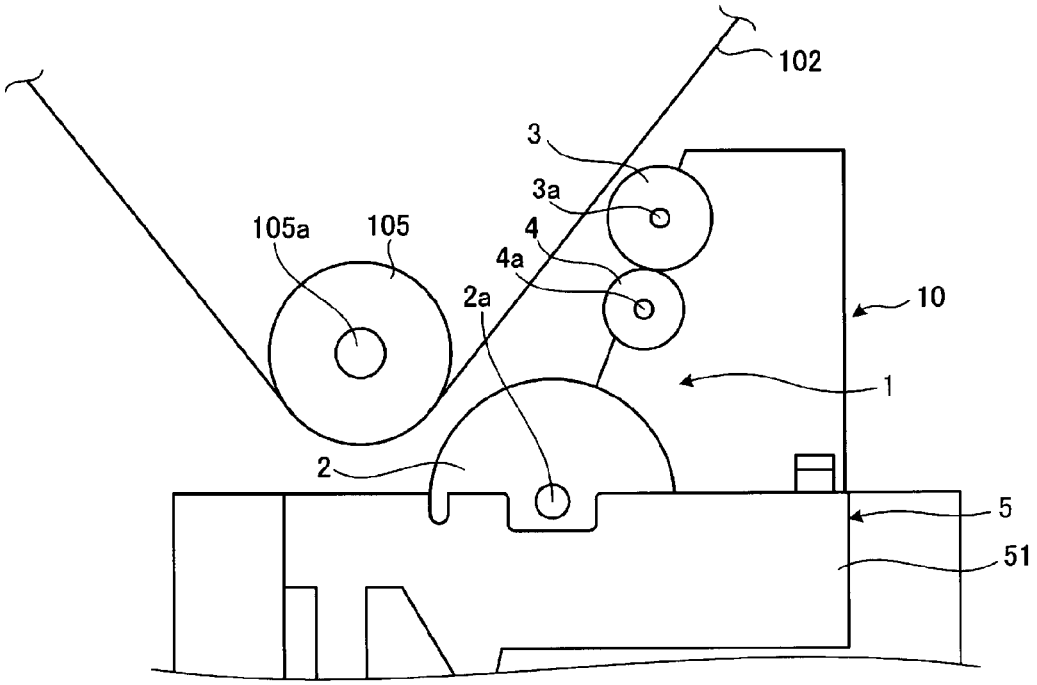
FIG. 5 is a partly enlarged view of the cleaning unit and the transport belt at a separated position according to the embodiment.
Figure 6:
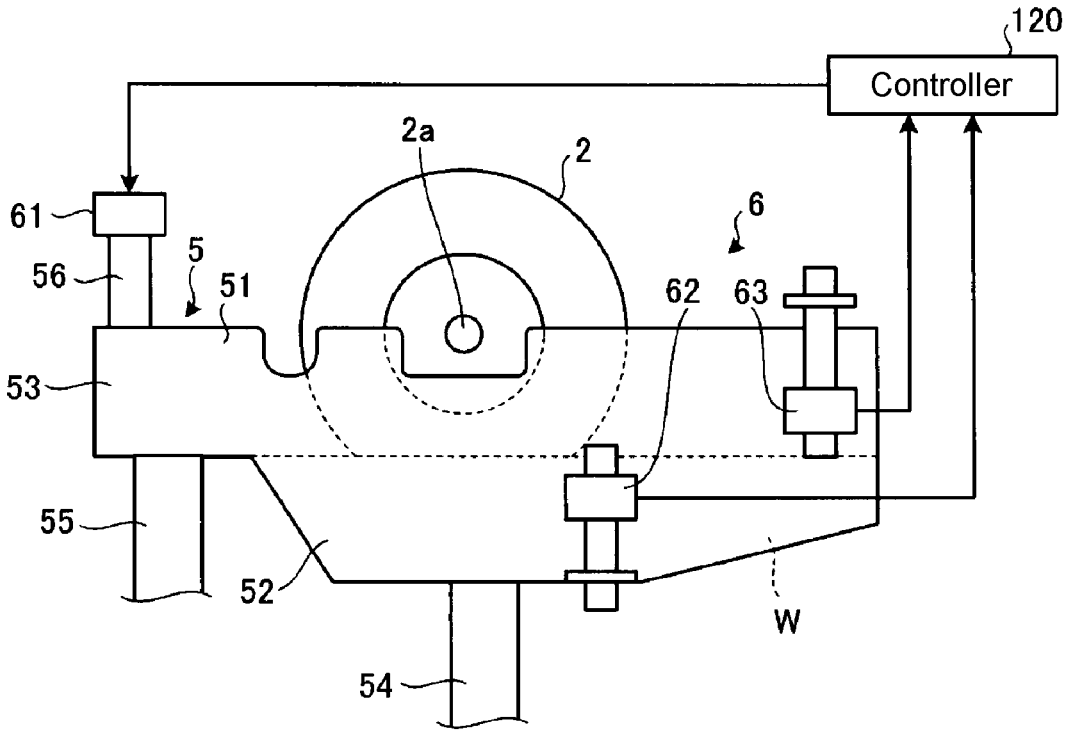
FIG. 6 is a partly enlarged view of the cleaning roller, the cleaning liquid tank, and a liquid level detecting mechanism of the cleaning unit according to the embodiment.

FIG. 1 is a schematic front view of an inkjet printer equipped with a cleaning unit according to an embodiment. FIG. 2 is a schematic perspective view of the inkjet printer equipped with a cleaning unit according to the embodiment. FIG. 3 is a schematic perspective view of a cleaning roller, a cleaning liquid tank, and a moving mechanism of the cleaning unit according to the embodiment. FIG. 4 is a partly enlarged view of the cleaning unit and a transport belt at a contact position according to the embodiment. FIG. 5 is a partly enlarged view of the cleaning unit and the transport belt at a separated position according to the embodiment. FIG. 6 is a partly enlarged view of the cleaning roller, the cleaning liquid tank, and a liquid level detecting mechanism of the cleaning unit according to the embodiment.

A cleaning unit 10 according to this embodiment is used to clean an inkjet printing device (recording apparatus, hereinafter, referred to inkjet printer) 100.

As illustrated in FIG. 1 and FIG. 2, the inkjet printer 100 has an inkjet head (recording device) 101, a transport device 106, pedestals 110, a controller 120, and a cleaning unit 10. The inkjet head (recording device) 101 discharges inks onto an object which is a print target medium. The transport device 106 transports the print target medium using an endless transport belt 102 placed around a first roller 103, a second roller 104, and a third roller 105.

The object is the print target medium (medium). The medium M may be selected from various articles, such as fabric, paper, plate, or structure.

The inkjet head 101 performs a recording on the medium M. The inkjet head 101 discharges inks onto the medium M on the transport belt 102. The inkjet head 101 has a plurality of nozzles for different color inks, for example, cyan (C), magenta (M), yellow (Y), black (K), white, and other color inks. The inkjet printer 100 may have one inkjet head 101 or plural inkjet heads 101.

The transport belt 102 transports the medium M. The transport belt 102 is formed with an endless sheet-like material. A length of the transport belt 102 in a width direction is longer than a length of the medium M in the width direction. The transport belt 102 is placed around the first roller 103, the second roller 104, and the third roller 105. The transport belt 102 is rotatably supported by the first roller 103, the second roller 104 and the third roller 105, so as to move in a direction of cyclic motion (transport direction) A. The transport belt 102 places the medium M on a transporter 102*a* between the first roller 103 and the second roller 104. The transport belt 102 transports the medium M in a state that the medium M is loaded on the transporter 102*a*. The transporter 102*a* is disposed along a plane in a horizontal direction.

In the following description, an upstream side and a downstream side in the direction of cyclic motion A of the transport belt 102 may be respectively referred to as, simply, "upstream" and "downstream".

An adhesive is applied to an outer peripheral surface of the transport belt 102. The transport belt 102 is temporarily secured to the medium M with the adhesive.

When the cleaning unit 10 is at a contact position, the transport belt 102 is rotationally moved. And, when the cleaning unit 10 is at a separated position, a rotation movement of the transport belt 102 is constrained.

Depending on the printing conditions, even when the cleaning unit 10 is not at the contact position, the transport belt 102 may be allowed to be rotationally moved.

The first roller 103 is rotatable to support the transport belt 102. The first roller 103 has a columnar or cylindrical shape. The length of the first roller 103 along its rotating shaft is greater than the length in the width direction of the transport belt 102.

The first roller 103 is disposed at a position on the upstream side of the transporter 102*a* of the transport belt 102 in the transport direction. The first roller 103 is disposed upstream relative to the second roller 104 and downstream relative to the third roller 105. The first roller 103 is disposed at a vertically lower position than the inkjet head 101. A rotating shaft 103*a* of the first roller 103 is along a plane in the horizontal direction.

The second roller 104 is rotatable to support the transport belt 102. The second roller 104 has a columnar or cylindrical shape. The length of the second roller 104 along its rotating shaft is greater than the length in the width direction of the transport belt 102.

The second roller 104 is disposed at a position on the downstream side of the transporter 102*a* of the transport belt 102. The second roller 104 is disposed downstream relative to the first roller 103 and upstream relative to the third roller 105. A rotating shaft 104*a* of the second roller 104 is vertically on the same level as the rotating shaft 103*a* of the first roller 103. The rotating shaft 104*a* of the second roller 104 is parallel to the rotating shaft 103*a* of the first roller 103.

The third roller 105 is rotatable to support the transport belt 102. The third roller 105 has a columnar or cylindrical shape. The length of the third roller 105 along its rotating shaft is greater than the length in the width direction of the transport belt 102.

The third roller 105 is disposed upstream relative to the first roller 103 and downstream relative to the second roller 104. The third roller 105 is disposed at a position below the first and second rollers 103, 104. A rotating shaft 105*a* of the third roller 105 is on the vertically lower side than the rotating shafts 103*a*, 104*a* of the first and second rollers 103, 104. The rotating shaft 105*a* of the third roller 105 is parallel to the rotating shafts 103*a*, 104*a* of the first and second rollers 103, 104.

The first roller 103, the second roller 104, and the third roller 105 are driven by a drive mechanism not illustrated in the drawings. The drive mechanism may include a motor. The drive mechanism may be coupled to the rotating shaft 104*a* of the second roller 104, so as to rotate the rotating shaft 104*a* of the second roller 104. In this embodiment, the rotating shaft 104*a* of the second roller 104 rotates counterclockwise. In this embodiment, the second roller 104 is a driving roller, while the first and third rollers 103, 105 are driven rollers. The drive mechanism, instead of being coupled to the second roller 104 alone, may be coupled to the second roller 104 and one or both of the first roller 103 and the third roller 105, or may be coupled to the first roller 103, the second roller 104, and the third roller 105.

The medium M is transported between the first and second rollers 103, 104 by the transport device 106 from the first roller 103 toward the second roller 104.

The pedestals 110 support the medium M in roll-shape, and also supports the respective components and devices of the inkjet printer 100. The pedestals 110 are secured to the floor surface.

The controller 120 includes CPU (Central Processing Unit) in charge of computing processes, and a memory including a program for processes hereinafter described. The controller 120 also includes a drive circuit that activates and deactivates the respective components and devices of the inkjet printer 100. A program, which is run for the controller 120 to execute the computing processes, may be stored in a storage device connectable to the inkjet printer 100 or a computer externally provided (including resources built on the Internet). Based on the program run to execute the processes below, the controller 120 controls the whole operation including the processes.

A detected result from a liquid level detecting mechanism 6 is inputted to the controller 120. The controller 120, based on the inputted detected result, outputs a control signal to an on-off valve 61 of the liquid level detecting mechanism 6.

As illustrated in FIG. 1 to FIG. 3, the cleaning unit 10 makes contact with the transport belt 102 in its width direction, so as to clean the transport belt 102 with a cleaning liquid W. The cleaning unit 10 has a cleaner 1, a cleaning liquid tank 5, a liquid level detecting mechanism 6 (see FIG. 6), and a moving mechanism 7 that moves the cleaner 1 between a contact position and a separated position.

As illustrated in FIG. 4, the contact position refers to a position at which a cleaning roller 2 and a suction roller 3 contact the transport belt 102. As illustrated in FIG. 5, the separated position refers to a position at which the cleaning roller 2 and the suction roller 3 are away from the transport belt 102. A horizontal direction connecting the contact position and the separated position is referred to as a contact-separated direction B.

The cleaner 1 has a cleaning roller 2, a suction roller 3, and a squeezing roller 4. The cleaner 1 is disposed at a position below the first roller 103 and above the third roller 105.

As illustrated in FIG. 1 and FIG. 2, the cleaning roller 2 is rotatable to clean the transport belt 102. The cleaning roller 2 contacts the transport belt 102 and cleans the transport belt 102 with the cleaning liquid W. The cleaning roller 2 has a columnar or cylindrical shape. The length of the cleaning roller 2 along its rotating shaft is greater than or equal to the length in the width direction of the transport belt 102. Thus, the length of the cleaning roller 2 along its rotating shaft is large enough to make contact with the whole surface of the transport belt 102 in its width direction. The cleaning roller 2 is a brush-like member. The cleaning roller 2 has bristles directed radially outward on its outer peripheral surface.

The cleaning roller 2 is disposed upstream relative to the first roller 103 and downstream relative to the third roller 105. A rotating shaft 2*a* of the cleaning roller 2 is parallel to the rotating shaft 103*a* of the first roller 103. The rotating shaft 2*a* of the cleaning roller 2 is on the vertically lower side than the rotating shaft 103*a* of the first roller 103. The rotating shaft 2*a* of the cleaning roller 2 is closer to the third roller 105 in the contact-separated direction B than the rotating shaft 103*a* of the first roller 103. The rotating shaft 2*a* of the cleaning roller 2 is on the vertically lower side than the rotating shaft 105*a* of the third roller 105. The rotating shaft 2*a* of the cleaning roller 2 may be closer to the first roller 103 in the contact-separated direction B than the rotating shaft 105*a* of the third roller 105.

As illustrated in FIG. 3 and FIG. 6, a lower part of the cleaning roller 2 is immersed in the cleaning liquid W in the cleaning liquid tank 5, so as to apply the cleaning liquid W of the cleaning liquid tank 5 to the cleaning roller 2. Any extraneous matter attached to the transport belt 102 may be scraped off by the cleaning roller 2 and washed off with the cleaning liquid W of the cleaning liquid tank 5. The cleaning roller 2, by having its lower part immersed in the cleaning liquid W in the cleaning liquid tank 5, may maintain an adequate cleaning performance.

An adhesive applied to the surface of the transport belt 102 temporarily secures the medium M to the transport belt 102. Examples of extraneous matter possibly attached to the transport belt 102 may include waster fiber and/or excess ink transferred from the medium M.

As illustrated in FIG. 1 and FIG. 2, the rotating shaft 2*a* of the cleaning roller 2 is coupled to a driver 2M. The rotating shaft 2*a* of the cleaning roller 2 rotates in the same direction as the rotating shafts of the first roller 103, the second roller 104, and the third roller 105. In this embodiment, the cleaning roller 2 rotates counterclockwise.

The rotational speed of the cleaning roller 2 may be changeable in response to the transport speed of the transport belt 102. For example, the cleaning roller 2 may have a higher rotational speed when an average transport speed of the transport belt 102 is relatively high (for example, printing pass number is three or less) than when the average transport speed of the transport belt 102 is relatively low (for example, printing pass number is four or more).

The cleaning roller 2 at the contact position is described referring to FIG. 4. The cleaning roller 2 forces the transport belt 102 to abut the third roller 105 which is as an abutting portion, specifically, the cleaning roller 2 presses the transport belt 102 toward the third roller 105. This may allow the cleaning roller 2 to avoid loss of contact with the transport belt 102.

The cleaning roller 2 at the separated position is described referring to FIG. 5. The cleaning roller 2 is at a position away from the transport belt 102 to avoid any contact with the transport belt 102.

As illustrated in FIG. 1 and FIG. 2, the drive device 2M may include a motor. The drive device 2M is coupled to the rotating shaft 2*a* of the cleaning roller 2, so as to rotate the rotating shaft 2*a* of the cleaning roller 2.

The suction roller 3 contacts the transport belt 102 and suctions the cleaning liquid W from the transport belt 102. The suction roller 3 has a columnar or cylindrical shape. The length of the suction roller 3 along its rotating shaft is greater than or equal to the length in the width direction of the transport belt 102. Thus, the length of the suction roller 3 along its rotating shaft is large enough to make contact with the whole surface of the transport belt 102 in its width direction. The suction roller 3 may be made from a porous, water-absorptive material, for example, a sponge material.

The suction roller 3 is disposed downstream relative to the cleaning roller 2 and upstream relative to the first roller 103. A rotating shaft 3*a* of the suction roller 3 is parallel to the rotating shaft 103*a* of the first roller 103. The rotating shaft 3*a* of the suction roller 3 is on the vertically upper side than the rotating shaft 2*a* of the cleaning roller 2. The rotating shaft 3*a* of the suction roller 3 is closer to the first roller 103 in the contact-separated direction B than the rotating shaft 2*a* of the cleaning roller 2. The rotating shaft 3*a* of the suction roller 3 is on the vertically lower side than the rotating shaft 103*a* of the first roller 103. The rotating shaft 3*a* of the suction roller 3 is closer to the third roller 105 in the contact-separated direction B than the rotating shaft 103*a* of the first roller 103.

A lower, outer-peripheral part of the suction roller 3 contacts the outer periphery of the squeezing roller 4, so as to have the squeezing roller 4 squeeze the suctioned cleaning liquid W off the suction roller 3. This may allow the suction roller 3 to keep its water-absorption capacity.

The cleaning liquid tank 5 is disposed at a vertically lower position than the suction roller 3. The cleaning liquid W dripping from the suction roller 3 drops into the cleaning liquid tank 5.

At the contact position, friction generated between the suction roller 3 and the transport belt 102 leads the suction roller 3 to follow the movement of the transport belt 102. In this embodiment, the suction roller 3 rotates clockwise.

The suction roller 3 at the contact position is described referring to FIG. 4. The suction roller 3, horizontally pushing the transport belt 102 inward by approximately 10 mm, contacts the transport belt 102.

The suction roller 3 at the separated position is described referring to FIG. 5. The suction roller 3 is at a position away from the transport belt 102 to avoid any contact with the transport belt 102.

As illustrated in FIG. 1 and FIG. 2, the squeezing roller 4 contacts the suction roller 3 to squeeze the cleaning liquid W off the suction roller 3. The squeezing roller 4 has a columnar or cylindrical shape. The length of the squeezing roller 4 along its rotating shaft is greater than the length of the suction roller 3 along its rotating shaft. Thus, the length of the squeezing roller 4 along its rotating shaft is large enough to make contact with the whole surface of the suction roller 3 along its rotating shaft. In this embodiment, the squeezing roller 4 is smaller in diameter than the suction roller 3. The squeezing roller 4 is made from a material having rigidity.

The squeezing roller 4 is disposed downstream relative to the cleaning roller 2 and upstream relative to the suction roller 3. A rotating shaft 4*a* of the squeezing roller 4 is parallel to the rotating shaft 103*a* of the first roller 103. The rotating shaft 4*a* of the squeezing roller 4 is on the vertically upper side than the rotating shaft 2*a* of the cleaning roller 2. The rotating shaft 4*a* of the squeezing roller 4 is closer to the first roller 103 in the contact-separated direction B than the rotating shaft 2*a* of the cleaning roller 2. The rotating shaft 4*a* of the squeezing roller 4 is on the vertically lower side than the rotating shaft 3*a* of the suction roller 3. The rotating shaft 4*a* of the squeezing roller 4 is closer to the third roller 105 in the contact-separated direction B than the rotating shaft 3*a* of the suction roller 3.

As illustrated in FIG. 4, the axis of the rotating shaft 4*a* of the squeezing roller 4 is on the opposite side of the transport belt 102 across a straight line passing through the axes of the rotating shafts 2*a*, 3*a* of the cleaning roller 2 and of the suction roller 3. The axis of the rotating shaft 4*a* of the squeezing roller 4 is on the vertically lower side than the axis of the rotating shaft 3*a* of the suction roller 3 and is closer to the transport belt 102 than the axis of the rotating shaft 3*a* of the suction roller 3.

A distance between the rotating shafts 4*a* and 2*a* of the squeezing roller 4 and of the cleaning roller 2 is greater than a summed radius of the squeezing roller 4 and of the cleaning roller 2. The squeezing roller 4 is at a position away from the cleaning roller 2.

A distance between the rotating shafts 4*a* and 3*a* of the squeezing roller 4 and of the suction roller 3 is less than a summed radius of the squeezing roller 4 and of the suction roller 3. This may allow the squeezing roller 4 to press and constrict the outer periphery of the suction roller 3 radially inward to squeeze the cleaning liquid W off the suction roller 3.

The cleaning liquid tank 5 is disposed at a vertically lower position than the squeezing roller 4. The cleaning liquid W squeezed off the suction roller 3 by the squeezing roller 4 drops into the cleaning liquid tank 5.

Friction generated between the squeezing roller 4 and the suction roller 3 leads the squeezing roller 4 to follow the movement of the suction roller 3. In this embodiment, the squeezing roller 4 rotates counterclockwise.

The squeezing roller 4 at the contact position and the separated position is described referring to FIG. 4 and FIG. 5. The squeezing roller 4 is at a position away from the transport belt 102 to avoid any contact with the transport belt 102.

The cleaning roller 2, the suction roller 3, and the squeezing roller 4 thus characterized are altogether mounted to the cleaning liquid tank 5. The cleaning roller 2, the suction roller 3, and the squeezing roller 4, and the cleaning liquid tank 5 are securely mounted, with their positions being fixed relative to one another.

As illustrated in FIG. 3 and FIG. 6, at least a part of the cleaner 1 is included in the cleaning liquid tank 5, and the cleaning liquid tank 5 stores the cleaning liquid W. A lower part of the cleaning roller 2 is immersed in the cleaning liquid W stored in the cleaning liquid tank 5. The cleaning liquid tank 5 has a body 51, a first drain pipe 54, a second drain pipe 55, and a feed pipe 56.

The body 51 is a box-shaped container having an opening on its upper side. The longitudinal length of the body 51 viewed in the vertical direction is greater than the length of the cleaning roller 2 along its rotating shaft. The lateral length of the body 51 viewed in the vertical direction is greater than the diameter of the cleaning roller 2, i.e., the body 51 is so shaped and sized that allows the body 51 to accommodate the cleaning roller 2. In the body 51, the lower portion 52 is constantly filled with the cleaning liquid W. The cleaning liquid W, if exceeding an upper limit of the lower portion 52, is temporarily kept in the upper portion 53 of the body 51. The cross-sectional area of the upper portion 53, when viewed in the vertical direction, is greater than the cross-sectional area of the lower portion 52.

The first drain pipe 54 is an outlet for draining the cleaning liquid W from the body 51. The first drain pipe 54 communicates with a lower part of the lower portion 52. The first drain pipe 54 is normally closed. In advance of maintenance, for example, the first drain pipe 54 is opened to drain the cleaning liquid W out of the cleaning liquid tank 5.

The second drain pipe 55 is another outlet for draining the cleaning liquid W from the body 51. The second drain pipe 55 communicates with a lower part of the upper portion 53. The second drain pipe 55 is normally open. The cleaning liquid W, if exceeding an upper limit of the upper portion 53, is drained through the second drain pipe 55 from the cleaning liquid tank 5.

The feed pipe 56 feeds the body 51 with the cleaning liquid W. The feed pipe 56 communicates with the upper portion 53 of the body 51. The feed pipe 56 constantly feeds the cleaning liquid W.

The liquid level detecting mechanism 6 detects a liquid level in the cleaning liquid tank 5. The liquid level detecting mechanism 6 has an on-off valve 61, a first sensor 62, and a second sensor 63.

The on-off valve 61 is coupled to the feed pipe 56 of the cleaning liquid tank 5. By opening or closing the on-off valve 61, the cleaning liquid W starts to flow through the feed pipe 56 into the cleaning liquid tank 5, or the liquid flow is blocked. The on-off valve 61 is opened or closed in response to control signals outputted from the controller 120. The on-off valve 61 is normally open. In other words, the cleaning liquid W flows into the cleaning liquid tank 5 at all times through the on-off valve 61 and the feed pipe 56, with any excess of the cleaning liquid W being constantly drained out.

The first sensor 62 detects the liquid level of the cleaning liquid W in the cleaning liquid tank 5. An example of the first sensor 62 is a float liquid level sensor. The first sensor 62 is disposed in the lower portion 52 of the cleaning liquid tank 5. The first sensor 62 detects whether the liquid level of the cleaning liquid W has reached a predetermined level in the lower portion 52 of the cleaning liquid tank 5. Then, the first sensor 62 outputs a detected result to the controller 120. The liquid level of the cleaning liquid W below a predetermined level in the lower portion 52 of the cleaning liquid tank 5 may suggest insufficiency of the cleaning liquid W to immerse the cleaning roller 2.

The second sensor 63 detects the liquid level of the cleaning liquid W in the cleaning liquid tank 5. An example of the second sensor 63 is a float liquid level sensor. The second sensor 63 is disposed in the upper portion 53 of the cleaning liquid tank 5. The second sensor 63 detects whether the liquid level of the cleaning liquid W has reached a predetermined level in the upper portion 53 of the cleaning liquid tank 5. The second sensor 63 thereby detects possible overflow of the cleaning liquid W from the upper portion 53 of the cleaning liquid tank 5. The second sensor 63 outputs a detected result to the controller 120. The liquid level of the cleaning liquid W equal to or above a predetermined level in the upper portion 53 of the cleaning liquid tank 5 may suggest possible outflow of the cleaning liquid W from the cleaning liquid tank 5.

The cleaning liquid W is found to be at a normal liquid level when the liquid level of the cleaning liquid W is detected by the first sensor 62 but is not detected by the second sensor 63. The cleaning liquid W is found to be beyond a normal liquid level when the liquid level of the cleaning liquid W is not detected by the first sensor 62 or when the liquid level is detected by the second sensor 63.

The moving mechanism 7 supports the cleaner 1 and the cleaning liquid tank 5. Specifically, the moving mechanism 7 moves the cleaning roller 2, the suction roller 3, the squeezing roller 4, the cleaning liquid tank 5, and the liquid level detecting mechanism 6 in the contact-separated direction B parallel to the transport direction of the medium M on the transporter 102*a*. The moving mechanism 7 reciprocates the cleaning roller 2 and the suction roller 3 between the contact position and the separated position. The moving mechanism 7 reciprocates the cleaning roller 2, the suction roller 3, the squeezing roller 4, and the cleaning liquid tank 5, with their positions being fixed relative to one another, between the contact position and the separated position.

The moving mechanism 7 includes guide rails 71, a movable member 72, a ball screw 73 rotatable around an axis of rotation, and a drive device 7M that rotates the ball screw 73 around the axis of rotation.

The guide rails 71 are disposed along the contact-separated direction B. The cleaning roller 2, the suction roller 3, the squeezing roller 4, the cleaning liquid tank 5, and the liquid level detecting mechanism 6 are supported by the guide rails 71, so as to move in the contact-separated direction B.

The movable member 72 moves in the contact-separated direction B along the guide rails 71. The cleaning liquid tank 5, with the cleaning roller 2 of the cleaner 1, the suction roller 3, the squeezing roller 4, and the liquid level detecting mechanism 6 integrally mounted to the tank, are loaded on the movable member 72.

The ball screw 73 is coupled to the movable member 72. The ball screw 73 is rotated by the drive device 7M. The rotation of the ball screw 73 leads the movable member 72 to move in the contact-separated direction B.

The drive device 7M may include a motor. The drive device 7M may be coupled to the ball screw 73 to rotate the ball screw 73.

Next, the operation of the cleaning unit 10 is described.

When the inkjet printer 100 is ready to be activated, the lower portion 52 in the body 51 of the cleaning liquid tank 5 is filled with the cleaning liquid W. The lower part of the cleaning roller 2 is immersed in the cleaning liquid W in the cleaning liquid tank 5. At the time, the cleaning unit 10 is at the separated position.

Then, the inkjet printer 100 is activated, and the first sensor 62 and the second sensor 63 start to detect the liquid level of the cleaning liquid W. The first and second sensors 62, 63 each output a detected result to the controller 120.

When a printing-start instruction is inputted to the inkjet printer 100, the controller 120 outputs control signals operative to drive the devices and components of the printer based on the detected results obtained by the first and second sensors 62, 63. When the liquid level of the cleaning liquid W is found to be normal from the detected results of the first and second sensors 62, 63, the controller 120 drives the drive device 7M of the moving mechanism 7 to locate the cleaning unit 10 at the contact position.

The cleaning unit 10 at the contact position is described referring to FIG. 4. The cleaning roller 2 is pressing the transport belt 102 toward the third roller 105. The transport belt 102 abutting the third roller 105 may avoid loss of contact with the cleaning roller 2. The suction roller 3, pushing the transport belt 102 inward, contacts the transport belt 102.

When the cleaning unit 10 is located at the contact position, the controller 120 drives the drive mechanism of the second roller 104 and the drive device 2M of the cleaning roller 2.

The transport belt 102 is moved by the rotating rollers in the direction of cyclic motion A. The controller 120, while transporting the medium M using the transport belt 102, prompts the inkjet head 101 to discharge the inks onto the medium M to perform a printing on the medium M.

As illustrated in FIG. 4, the cleaning roller 2 rotates, pressing the whole surface of the transport belt 102 in its width direction toward the third roller 105. The transport belt 102 abutting the third roller 105 may avoid loss of contact with the cleaning roller 2. This may allow the cleaning roller 2 to scrape off any extraneous matter attached to the transport belt 102.

As illustrated in FIG. 3 and FIG. 6, when the cleaning roller 2 rotates, with its lower part being immersed in the cleaning liquid W in the cleaning liquid tank 5, the cleaning liquid W is applied to the cleaning roller 2. Any extraneous matter scraped off the transport belt 102 by the cleaning roller 2 may be washed off with the cleaning liquid W of the cleaning liquid tank 5. Thus, the cleaning roller 2 may successfully clean the transport belt 102 without losing an adequate cleaning performance.

The suction roller 3 makes contact with the whole surface of the transport belt 102 in its width direction. Then, the cleaning liquid W transferred to the transport belt 102 from the cleaning roller 2 is suctioned by the suction roller 3.

The squeezing roller 4 presses and constricts the outer periphery of the suction roller 3 radially inward, so as to squeeze the suctioned cleaning liquid W off the suction roller 3. This may allow the suction roller 3 to keep its water-absorption capacity and adequately suction the cleaning liquid W from the transport belt 102.

The cleaning liquid W, squeezed off the suction roller 3 by the squeezing roller 4, flows vertically downward along the outer peripheral surfaces of the suction roller 3 and of the squeezing roller 4, and drops into the cleaning liquid tank 5.

As described so far, the transport belt 102 is cleaned by the cleaning unit 10.

According to this embodiment, the cleaning roller 2 of the cleaner 1, the suction roller 3, and the squeezing roller 4 are integrally mounted to the cleaning liquid tank 5, and the cleaning liquid tank 5 is reciprocated by the moving mechanism 7 in the contact-separated direction B parallel to the transport direction of the medium M on the transporter 102*a*. Thus, the whole cleaning unit 10 is allowed to reciprocate at once in the contact-separated direction B parallel to the transport direction of the medium M. In this embodiment, therefore, the cleaning unit 10 and the inkjet printer 100 may be successfully reduced in size.

In this embodiment, the contact-separated direction B of the cleaning unit 10 refers to the horizontal direction parallel to the transport direction of the medium M, meaning that vertical movements are not required of the cleaning unit 10 according to this embodiment. Therefore, upsizing of the moving mechanism 7 may be unnecessary even if a wider transport belt and a correspondingly wider cleaning roller 2 are used. In this embodiment, therefore, the cleaning unit 10 and the inkjet printer 100 may be successfully reduced in size.

In this embodiment, the cleaner 1 is disposed at a position below the first roller 103 and above the third roller 105. This may ensure efficient removal of the cleaning liquid W from the transport belt 102 without having to upsize the cleaning unit 10.

In this embodiment, the cleaning unit 10 is disposed at a position on the upstream side of the transporter 102*a* of the transport belt 102. In this embodiment, therefore, the medium M may be transported on the transport belt 102 from which any extraneous matter has been removed by cleaning.

In this embodiment, the transport belt 102 abutting the third roller 105 may avoid loss of contact with the cleaning roller 2. This may allow the cleaning roller 2 to more reliably scrape off and remove any extraneous matter attached to the transport belt 102.

A better cleaning performance may be provided by constantly feeding the cleaning roller 2 with the cleaning liquid W during the cleaning of the transport belt 102. By having the downstream-side suction roller 3 suction the cleaning liquid W transferred from the cleaning roller 2 to the transport belt 102, the cleaning liquid W may be efficiently removed from the transport belt 102. Thus, better cleaning by and thorough removal of the cleaning liquid W may be both achieved.

In this embodiment, the suction roller 3, horizontally pushing the transport belt 102 inward by approximately 10 mm, contacts the transport belt 102. This may allow the suction roller 3 to closely contact the transport belt 102 and more reliably suction the cleaning liquid W from the transport belt 102.

In this embodiment, the suction roller 3 and the squeezing roller 4 are disposed at vertically upper positions than the cleaning liquid tank 5. Therefore, the cleaning liquid W squeezed off the suction roller 3 by the squeezing roller 4 may be pooled again in the cleaning liquid tank 5.

The axis of the rotating shaft 4*a* of the squeezing roller 4 is on the opposite side of the transport belt 102 across a straight line passing through the axes of the rotating shafts 2*a*, 3*a* of the cleaning roller 2 and of the suction roller 3. The axis of the rotating shaft 4*a* of the squeezing roller 4 is on the vertically lower side than the axis of the rotating shaft 3*a* of the suction roller 3 and is closer to the transport belt 102 than the axis of the rotating shaft 3*a* of the suction roller 3. This embodiment may further ensure that the cleaning liquid W squeezed off the suction roller 3 by the squeezing roller 4 drops into the cleaning liquid tank 5.

This embodiment, by changing the rotational speed of the cleaning roller 2 in response to the transport speed of the transport belt 102, may avoid wear and/or loss of the adhesive applied to the surface of the transport belt 102.

The embodiment described herein only provides a non-limiting example of the cleaning unit. The cleaning unit may be modified otherwise in various forms within the scope of the appended claims.

The cleaning roller 2 may press the transport belt 102 against any other suitable member but the third roller 105, for example, a roller disposed on the inner peripheral side of the endless transport belt 102.

Figure 7:
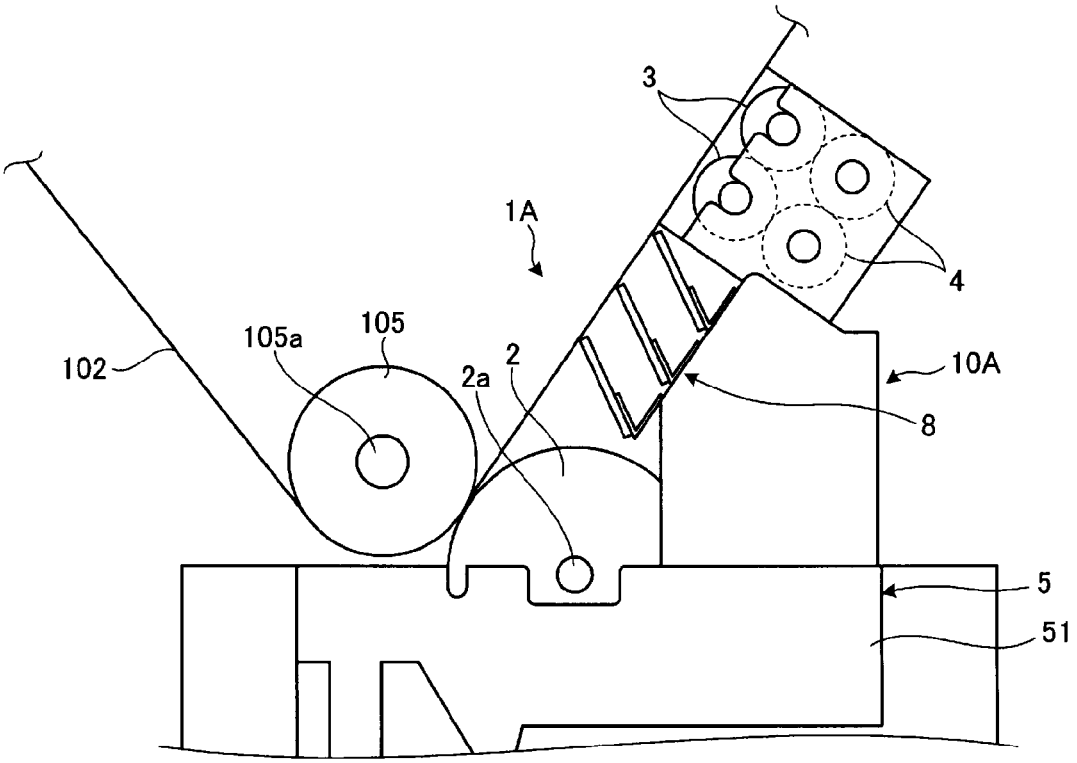
FIG. 7 is a partly enlarged view of another example of the cleaning unit according to the embodiment.

FIG. 7 shows another non-limiting example of the cleaning unit. FIG. 7 is a partly enlarged view of another cleaning unit according to the embodiment. Unlike the earlier embodiment, a cleaning unit 10A illustrated in FIG. 7 has wipers 8. The wipers 8 contact the transport belt 102 and removes the cleaning liquid W from the transport belt 102. The wipers 8 are disposed downstream relative to the cleaning roller 2 and upstream relative to the squeezing roller 4. The wiper 8 includes a flexible plate-like member. The cleaning liquid tank 5 is disposed at a vertically lower position than the wipers 8. The cleaning liquid W dripping from the wipers 8, therefore, may drop into the cleaning liquid tank 5. This cleaning unit 10A may effectively and reliably remove the cleaning liquid W from the transport belt 102.

What is claimed is:

1. A recording apparatus, comprising:

a transport device, configured to transport a print target medium using an endless transport belt placed around a plurality of rollers;

a recording device, configured to perform a recording on the print target medium on the endless transport belt; and a cleaning unit, configured to clean the endless transport belt, wherein the cleaning unit comprising:

a cleaner, comprising a cleaning roller and being configured to make contact with the endless transport belt in a width direction of the endless transport belt, so as to clean the endless transport belt with a cleaning liquid;

a cleaning liquid tank, configured to store the cleaning liquid, and at least a part of the cleaner is included in the cleaning liquid tank; and a moving mechanism, configured to support the cleaner and the cleaning liquid tank, and move the cleaner in a horizontal direction between a contact position at which the cleaner makes contact with the endless transport belt and a separated position at which the cleaner is separated from the endless transport belt, wherein the cleaner further comprises a suction roller disposed downstream in a transport direction of the endless transport belt relative to the cleaning roller, the suction roller is configured to make contact with the endless transport belt, so as to suction the cleaning liquid from the endless transport belt, wherein the cleaning roller and the suction roller are disposed at upper positions than the cleaning liquid tank in a vertical direction, wherein the plurality of rollers is arranged such that at least one roller is disposed below a print target medium load portion of the endless transport belt on which the print target medium is mounted;

wherein the cleaning roller is disposed in contact with the one roller with the endless transport belt therebetween, and the cleaning roller is disposed at a position where a straight line extending from a center of a rotating shaft of the one roller to a center of a rotating shaft of the cleaning roller is inclined at a predetermined angle with respect to the vertical direction;

wherein the cleaning liquid tank is provided in a range that is capable of receiving the cleaning liquid dripped by gravity from the suction roller, wherein the moving mechanism includes a guide rail for moving the cleaning roller in a state parallel to the width direction of the endless transport belt, wherein the cleaning roller and the suction roller are arranged to be fixed in a relative positional relationship at least in a moving direction of the parallel state.

2. The recording apparatus according to claim 1, wherein the plurality of rollers comprises at least a first roller, a second roller, and a third roller, the print target medium is transported between the first roller and the second roller from the first roller toward the second roller, the third roller is disposed at a position below the first roller and the second roller.

3. The recording apparatus according to claim 2, wherein the cleaner is configured to contact the endless transport belt by pressing the endless transport belt against the third roller.

4. The recording apparatus according to claim 3, wherein an outer periphery of the cleaning roller is partly immersed in the cleaning liquid stored in the cleaning liquid tank.

5. The recording apparatus according to claim 4, wherein the cleaning roller is configured to have a rotational speed changeable in response to an average transport speed of the endless transport belt.

6. The recording apparatus according to claim 2, wherein an outer periphery of the cleaning roller is partly immersed in the cleaning liquid stored in the cleaning liquid tank.

7. The recording apparatus according to claim 1, wherein an outer periphery of the cleaning roller is partly immersed in the cleaning liquid stored in the cleaning liquid tank.

8. The recording apparatus according to claim 7, wherein the cleaning roller is configured to have a rotational speed changeable in response to an average transport speed of the endless transport belt.

9. The recording apparatus according to claim 1, wherein the cleaning unit further comprises:

a squeezing roller, configured to make contact with the suction roller, so as to squeeze the cleaning liquid off the suction roller, wherein an axis of a rotating shaft of the squeezing roller is on a side opposite to the endless transport belt across a straight line passing through axes of rotating shafts of the cleaning roller and of the suction roller.

10. The recording apparatus according to claim 9, wherein the axis of the rotating shaft of the squeezing roller is on a vertically lower side than the axis of the rotating shaft of the suction roller and is closer to the transport belt than the axis of the rotating shaft of the suction roller.

11. The recording apparatus according to claim 10, wherein the cleaning roller is configured to have a rotational speed changeable in response to an average transport speed of the endless transport belt.

12. The recording apparatus according to claim 9, wherein the cleaning roller is configured to have a rotational speed changeable in response to an average transport speed of the endless transport belt.

13. The recording apparatus according to claim 6, wherein the cleaning roller is configured to have a rotational speed changeable in response to an average transport speed of the endless transport belt.

14. A recording apparatus, comprising:

a transport device, configured to transport a print target medium using an endless transport belt placed around a plurality of rollers;

a recording device, configured to perform a recording on the print target medium on the endless transport belt; and a cleaning unit, configured to clean the endless transport belt, wherein the cleaning unit comprising:

a cleaner, comprising a cleaning roller and being configured to make contact with the endless transport belt in a width direction of the endless transport belt, so as to clean the endless transport belt with a cleaning liquid;

a cleaning liquid tank, configured to store the cleaning liquid, and at least a part of the cleaner is included in the cleaning liquid tank;

a moving mechanism, configured to support the cleaner and the cleaning liquid tank, and move the cleaner in a horizontal direction between a contact position at which the cleaner makes contact with the endless transport belt and a separated position at which the cleaner is separated from the endless transport belt;

wherein the cleaner further comprises:

a suction roller, disposed downstream in a transport direction of the endless transport belt relative to the cleaning roller, the suction roller is configured to make contact with the endless transport belt, so as to suction the cleaning liquid from the endless transport belt; and a squeezing roller, configured to make contact with the suction roller, so as to squeeze the cleaning liquid off the suction roller, wherein an axis of a rotating shaft of the squeezing roller is on a side opposite to the endless transport belt across a straight line passing through axes of rotating shafts of the cleaning roller and of the suction roller.

15. The recording apparatus according to claim 14, wherein the axis of the rotating shaft of the squeezing roller is on a vertically lower side than the axis of the rotating shaft of the suction roller and is closer to the transport belt than the axis of the rotating shaft of the suction roller.

16. The recording apparatus according to claim 15, wherein the cleaning roller is configured to have a rotational speed changeable in response to an average transport speed of the endless transport belt.

17. The recording apparatus according to claim 14, wherein the cleaning roller is configured to have a rotational speed changeable in response to an average transport speed of the endless transport belt.

* * * * *